United States Patent [19]

Miller

[11] Patent Number: 4,837,867

[45] Date of Patent: Jun. 13, 1989

[54] DUAL FLUSH SYSTEM FOR TOILETS

[76] Inventor: John B. Miller, 110 W. Los Robles, Green Valley, Ariz. 85614

[21] Appl. No.: 173,055

[22] Filed: Mar. 25, 1988

[51] Int. Cl.[4] ..... E03D 1/14

[52] U.S. Cl. ..... 4/324; 4/415

[58] Field of Search ..... 4/324, 325, 415

[56] References Cited

U.S. PATENT DOCUMENTS

| | | | |
|---|---|---|---|
| 2,602,934 | 7/1952 | McCormack et al. | 4/324 |
| 2,754,521 | 7/1956 | Marcum . | |
| 2,835,900 | 5/1958 | Gleason | 4/324 |
| 3,151,337 | 10/1964 | Deniz . | |
| 3,894,299 | 7/1975 | Cleary . | |
| 3,903,551 | 9/1975 | Johnson . | |
| 3,906,554 | 9/1975 | Johnson . | |
| 4,195,373 | 9/1980 | Claywell . | |
| 4,216,555 | 8/1980 | Detjen | 4/325 |
| 4,353,138 | 10/1982 | Bell . | |
| 4,750,220 | 6/1988 | Baumann | 4/324 |

*Primary Examiner*—Edward L. Roberts

*Attorney, Agent, or Firm*—J. Michael McClanahan

[57] ABSTRACT

A dual flush system for toilets to effect a partial or mini-flush of the toilet to carry away liquid wastes by partially opening of the main valve situated in the water holding tank of the toilet or a period of time determined by an operator. So long as the main valve is only opened slightly, downward pressure upon the main valve and suction forces of water passing between the main valve and valve seat exert a downward force on the main valve with the effect that the main valve is pulled back into a closed position after opening. Only when the main valve is raised to a position where its buoyancy exceeds downward pressures is a full flush effected. Accordingly, the described device provides means to limit the upward lifting of the main valve by limiting the lengthwise travel of a cord attached to the main valve, the cord having attached at its other end variously a pull ring or flush handle and lever. Lengthwise travel of the cord is terminated by a stop attached to the cord which strikes an outstanding arm attached to the toilet overflow pipe. An additional embodiment utilizes a spring mechanism to increase resistance at a set point to the main flush handle movement to indicate that point at which a partial flush continues into a complete flush.

6 Claims, 2 Drawing Sheets

DUAL FLUSH SYSTEM FOR TOILETS

BACKGROUND OF THE INVENTION

1. Field of the Invention

The field of the invention is modifications made to the standard available residential and commercial toilets of the type having a water holding tank and a bowl wherein means are provided to effect a partial flush of liquid wastes in the bowl.

2. Description of the Related Art

Toilets that are commonly in use consist of two main parts, the upper part which holds water, usually called the tank section, and the lower part comprising primarily a bowl with a volume of water which is designed to receive human waste products. Once the waste products have been deposited in the bowl, they are removed by releasing the water held in the upper water holding tank into the bowl which, through a specially designed system, removes the waste products to a collection system, such as a septic tank or sewer system, and then refills the bowl so that there is left standing a volume of water. Waste comprises both solid and liquid wastes and presently, in toilet systems now available, one flush is utilized to carry away both the solid and the liquid wastes, even for the occasions when there are only liquid wastes in the toilet bowl. In the presently available standard toilets, a full complete flush is effected with each flush and the total contents of the water holding tank drained into the bowl and then out into the sewer system.

In the standard toilets, the water tank holds water up to a level which is determined by a float activated valve which allows water to enter the tank to a predetermined level, and when that level is reached, the valve shuts down. In the base of the tank is located a valve seat with a main valve, often called "flapper valve", operating in and out of that valve seat. The valve seat surrounds a water discharge port comprising a pipe opening and associated pipe which runs from the water holding tank to the toilet bowl and which permits the held water to enter the toilet bowl. Located proximate the valve seat is an upright pipe, called the overflow pipe which permits excess water in the tank whose level is above the top of the overflow pipe to enter the overflow pipe, flow down through the overflow pipe and into the toilet bowl. The purpose of the overflow pipe is to prevent water from leaking out of the tank in the event that the water filling valve should malfunction causing the tank to otherwise overflow.

In the commonly available standard equipped toilets, the main valve which operates in and out of the valve seat is composed of soft pliable rubber and is buoyant in water. Presently, the main valve in most toilets is somewhat ball-shaped, having a surrounding overlapping flange on one side of the ball, with the flange being somewhat oval shaped with the extended portion of the flange containing over to engage a fixture attached to the overflow pipe. With the main valve in a closed position, the flange is generally in a horizontal position. This extending portion of the flange generally encompasses an outstanding rod attached to the fixture to provide a means by which the main valve may pivot out of its position on the valve seat. Attached to the flange opposite the point of pivoting is an upright protruding eyelet which is adapted to be tied to a cord, string, or a hook attached to a chain, the other end of the cord, string, or chain attached to a lever arm of a flush handle, the flush handle located outside the tank. When the flush handle is depressed, the lever arm interiorly to the tank rises, pulling upon the eyelet and pivoting upward the main valve off the valve seat and thus open the main valve. When the main valve has pivoted upward so that a certain distance exists between the main valve and the valve seat, the water pressure pushing down on the main valve plus the suction effect of the water rushing between the main valve and the valve seat is overcome by the buoyancy of the main valve and the main valve becomes buoyant and floats to a position where the flange appears to be pointing upward. The suction caused by the water rushing between the main valve and the valve seat is such as to attempt to pull the main valve back into position seated upon the valve seat. During the flushing of the toilet, the main valve is raised to a position where it becomes buoyant (and rises to its highest pivotal position) and then all the water in the water holding tank rushes through the opening in the center of the valve seat. Buoyant and buoyancy is defined as the tendency of an object to rise in a liquid. The water proceeds out the water discharge port, down the pipe connecting the water tank to the toilet bowl, and into the toilet bowl. As the water level in the tank drops to the main valve, the main valve begins to float at the water level and then when the water is completely or nearly exhausted, the main valve seats again upon the valve seat. Water entering the tank through the float activated valve then covers the main valve and holds it down.

In older toilets, the main valve comprises primarily a ball which has connected to it an outwardly and upwardly protruding elongated rod. The ball is kept in position over the valve seat by passing the rod through a positioning sleeve situated directly over the valve seat. At the end of the rod opposite the ball is an eyelet to which is attached the rope or chain from the flushing handle lever. This older style of main valve operates similarly as does the currently popular pivotable main valve.

With the efforts which have been popularized recently to save water, a number of inventions have been made to save water in the toilets commonly found in residences. Such efforts have included using smaller sized water holding tanks than used theretobefore, and/or redesigning the siphon system of the bowl which carries off the waste products to use less water. In addition, since one of the waste products is liquid waste, particularly urine, efforts have also been directed at effecting a partial flush where only a portion of the water stored in the tank is permitted to enter the bowl to carry off the liquid wastes.

In regard to the partial flush, a number of patents have been issued recently disclosing devices adapted to allow a measured amount of water from the water holding tank to enter the bowl. For example, Clary, in U.S. Pat. No. 3,894,299, discloses a dual flush system wherein a spring loaded valve is inserted into the tank overflow pipe whereby the valve allows water from the tank to flow into a submerged opening in the overflow pipe until the level in the tank reaches that opening.

Claywel, Johnson, Bell, and Marcum in U.S. Pat. Nos. 4,195,373, 3,903,551, 4,353,138, and 2,754,521 respectively, have disclosed partial flush systems utilizing two separate main valve systems, both of which lead to the bowl, one valve system adapted for the partial flush and the other valve system adapted for the full flush.

Finally, Deniz, in U.S. Pat. No. 3,151,337 discloses a unique dual flush system where two valves are configured into a serial type arrangement whereby the partial flush procedure allows a top valve to pass water through the interior of the main valve.

All of the prior art known to the Inventor as stated above, involves rather complicated mechanical means which change substantially the inner working parts of the toilet tank, and thus are quite expensive and complicated to manufacture, and thus not only expensive for the consumer, but require substantial labor in removing the present working parts located in the tank and replacing them with the devices shown in each of the patents.

It is apparent that it would be useful to provide a mechanism which requires minimum interchange of working parts of the toilet and which does not require extensive modification of the water holding tank.

Accordingly, there is an advantage of providing a dual system flush toilet wherein the majority of the inner working parts of a standard commercially available toilet system are not replaced, but the existing main valve and other parts directly associated with draining the water from the tank into the bowl are utilized with addition of a few elements.

SUMMARY OF THE INVENTION

This invention relates to a novel dual flush system for toilets to provide means of effecting a partial or mini-flush of the toilet bowl in addition to the main flush, primarily for the purposes of flushing liquid wastes from the bowl.

The inventive dual flush system comprises elements which are added to the normal and usual flush toilet located in residences and businesses. These elements consist of an arm attached to the existing overflow pipe, an additional cord, line, or chain which attaches to the existing main valve of the toilet, a stop which is threaded onto the additional line or cord, said stop having a butterfly headed screw adapted to engage the cord to hold it tight, and means by which the additional cord is pulled which has the effect of lifting the main valve a very small distance. This means to pull the second cord may comprise threading the second cord out of the toilet bowl to a finger ring, or installing a second and auxiliary flush handle and lever arm, the auxiliary flush handle operating concentrically with the main flush handle.

The invention functions by lifting the main valve situated in the toilet water holding tank a short distance above the valve seat to just open the main valve such as to permit water to run into the toilet bowl. The upward lifting of the main valve is limited by the stop engaging the arm attached to the overflow pipe in order that the main valve shall not be lifted above the point at which it becomes buoyant and then opens fully. As previously discussed, the Inventor has determined if the main valve is opened only slightly, downward forces upon the valve together with the suction effect of the water rushing between the valve and the valve seat provides a downward pull on the valve so that it returns to a closed position whenever the force holding the valve up terminates. However, if the valve is lifted beyond that point where the buoyant effect of the valve is greater than the downward pressure of the water on the valve plus the suction effect, then the valve will pivot upward, become fully open, and the full flush is then commenced and accomplished.

Various embodiments of the invention are shown utilizing the modern popular type of main valve which is made of soft pliable rubber and which operates by pivoting from a fixture attached to the overflow pipe, as well as the older type main valve utilizing a ball with an outwardly extending elongated rod guided through a sleeve which orients the main valve over the valve seat.

Still further embodiments of the invention include utilizing only an arm, spring, and stop wherein the standard handle and lever pull the stop attached to the original cord against the spring attached to the arm. By this embodiment, a person, operating the main flush lever, will lift the main valve the small required distance to effect a mini-flush or partial flush to the point the operator feels the stop engaging the spring. If the operator wishes to continue with a main flush, then he continues operating the flush handle, compressing the spring, and lifting the main valve up sufficiently until it becomes buoyant and no longer restricts water from the main tank into the bowl.

It is an object of the subject invention to provide a dual flush system for toilets comprising few parts and minor modifications to the standard toilet commonly available in residences and businesses.

It is another object of the subject invention to provide a dual flush system for toilets wherein the main valve of the toilet is manipulated to provide the partial flush.

It is still another object of the subject invention to provide a dual flush system for toilets wherein the main valve is lifted off the valve seat by a distance sufficient to permit the partial flush only.

It is still another object of the subject invention to provide a dual flush system for toilets wherein the main flush handle solely is utilized to firstly lift the main valve off the valve seat a small distance, and then if it is desired for a fully flush, the handle may be further operated against a spring to effect the full flush.

Other objects of the invention will in part be obvious and will in part appear hereinafter. The invention accordingly comprises the apparatus and method comprising construction, combination of elements, and arrangement of parts which are exemplified in the following detailed disclosure, and the scope of the Application which will be indicated.

DESCRIPTION OF THE DRAWINGS

For further understanding of the nature and objects of the present invention, reference should be had to the following detailed description taken in connection with the accompanying drawing wherein.

In various views, like index numbers refer to like elements.

DETAILED DESCRIPTION OF THE PREFERRED EMBODIMENT

Figure 1:
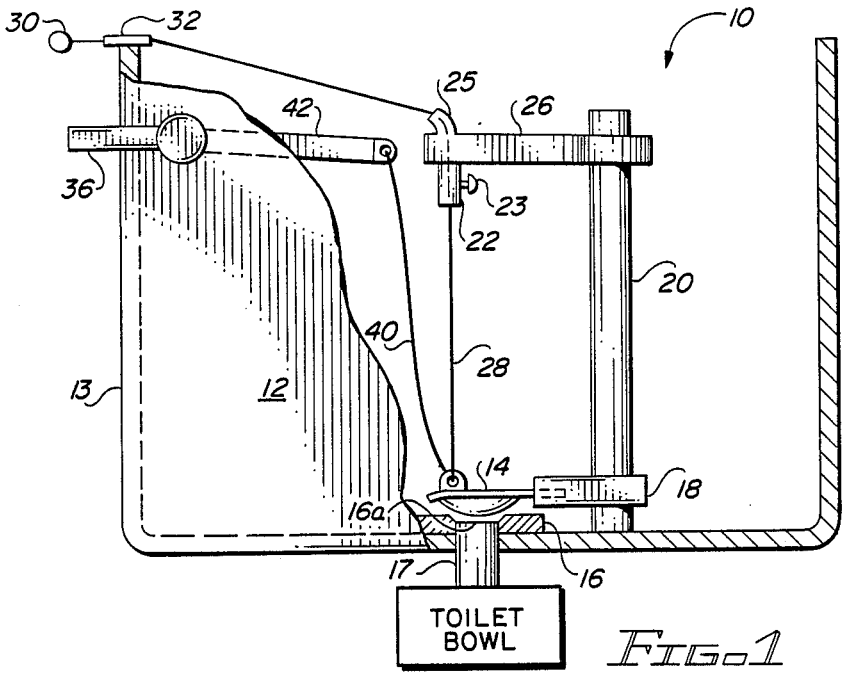
FIG. 1 is a front view of the preferred embodiment of the subject invention.

Referring now to FIG 1, a front view of the subject dual flush system for toilets is shown wherein a portion of the front wall 12 of water holding tank 10 has been cut away to show the invention. More specifically, the invention comprises the elements which permit the main valve 14 to be lifted by pivoting a small distance above valve seat 16 sufficient to permit water to flow between main valve 14 and valve seat 16 to effect a partial or "mini" flush of the toilet to carry away liquid wastes. By means of the apparatus comprising the invention, main valve 14 is raised or pivoted upward only a small distance such that the pressure of the water pushing downward on it and the venturi or suction effect of the water rushing between it and valve seat 16 is such as to overcome the normal buoyancy of main valve 14 to float upwardly. Thus, when main valve 14 is no longer being lifted, the pressure and suction pull it back to being seated on valve seat 16. Main valve 14, comprised primarily of soft pliable rubber, has an outstanding flange with an additional extension which attaches to fixture 18 which permits its being pivoted. Fixture 18 in turn attached to overflow pipe 20 by means of a set screw (not shown) or other holding means. The main valve 14, together with its attached fixture 18 are commonly available elements now present in consumer toilet assemblies used in residences and commercial restrooms. Centrally located to valve seat 16 is water discharge port 16*a* through which water flows to discharge pipe 17.

The upward lift applied to main valve 14 and thus its' opening is limited by limiting the travel of positionally attached stop 22, which comprises an elongated rather thick cylinder with a hole or opening running through it in the longitudinal direction, the hole penetrated on one side by set screw 23. Set screw 23 is adapted to engage cord 28 which passes through the lengthwise hole. Cord 28 connects at one end to an upward protruding eyelet attached to main valve 14 and, at its other end, to ring 30. Ring 30 is the mechanism which is grasped by the person wishing to effect a partial or mini-flush. Arm 26, also attaching to overflow pipe 20 and affixed there by means of a set screw (not shown) or other means, has at its distal end a centrally located hole or opening running therethrough, the hole adapted to receive and pass cord 28 previously described. The obvious function of arm 26 is to limit the travel of stop 22 and thereby the lengthwise travel of cord 28 a predetermined distance so that main valve 14 can be lifted above valve seat 16 only the small predetermined distance previously described such that the resultant forces operating upon main valve 14 are still to urge it to valve seat 16 and terminate water flowing through valve seat 16, water discharge port 16*a*, and pipe 17 to the bowl of the toilet.

Obviously, the partial or mini-flush is effected only as long as cord 28 is pulled and main valve 14 lifted. Releasing the cord allows main valve 14 to return to valve seat 16 and thus close.

Shown also in FIG. 1 is an added extension 25 rising above arm 26, the curved portion of extension 25 also having a central opening directing cord 28 to sleeve 32 resting upon the side wall of tank 10. Sleeve 32 is designed to interface between the top to tank 10 (not shown) so that ring 30 may still be pulled and the cord 28 activated to lift main valve 14 the required distance. Obviously, the purpose of extension is to make more gentle the curve around which cord 28 travels in order to reduce friction.

Because set screw 23 permits for adjustment of stop 22 along cord 28, the position of stop 22 on cord 28 is selected so that main valve 14 is raised a sufficient distance above valve seat 16 to pass a sufficient flow of water to effect the partial or mini-flush while yet not permitting the main valve 14 to rise so high that the natural buoyancy of main valve 14 exceeds downward pressure and suction, and the valve pivots so far upward as to not be able to return to valve seat 16, resulting in a full or complete flush.

In FIG. 1, the preferred embodiment is shown where the mini-flush is effected by pulling cord 28 utilizing finger ring 30. The remainder of the toilet shown in FIG. 1 comprises the regular full or complete flush handle 36 which is connected to lever arm 42, lever arm 42 having connected at its end original cord 40 which also attaches to the upward protruding eyelet of main valve 14. Whenever a full flush is desired, flush handle 36 is depressed, lever arm 42 thus raised, and main valve 14 lifted considerably above valve seat 16 to where it becomes buoyant and floats upwardly (main valve 14 becomes fully open) and all the water in tank 10 passes into the toilet bowl 21 (shown in diagramic form).

Figure 2:
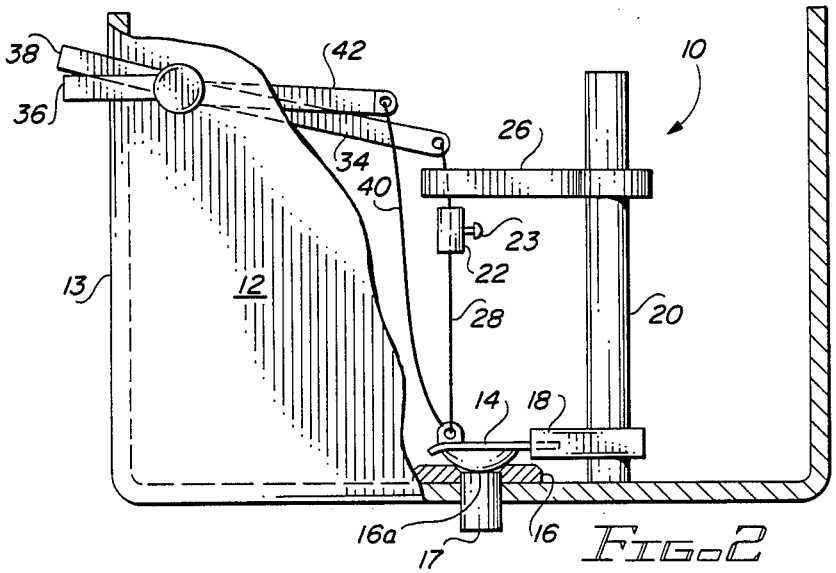
FIG. 2 is a front view of an alternate embodiment of the subject invention.

In FIG. 2, an alternate embodiment is shown where a second partial flush handle and lever arm, concentrically pivotable with the main flush handle, accomplishes the same purposes as that of the pull ring. More specifically, the only major change between FIGS. 1 and 2 has been the method by which the cord 28 is pulled, namely that the cord 28 exiting from the top of arm 26 is now attached to the end of lever 34, lever 34 pivoting at the same axis as does the usual flush handle 36. Attached to the end of lever 34 is the mini-flush handle 38.

The embodiment of the invention detailed in FIG. 2 operates similarly to that in FIG. 1, i.e., to effect a partial or mini-flush, the operator need only to push down on mini-flush handle 38 to pivot mini-flush lever 34 upwards drawing cord 28 upwards and lifting main valve 14 off valve seat 16 to begin opening main valve 14. Cord 28 will lengthwise travel a predetermined distance until stop 22 contacts the lower portion of arm 26. Obviously, because the end of mini-flush lever 34 is nearer the point at which cord 28 exits from the top hole of arm 26, it was not necessary to add the curved extension 25 to arm 26 as was done in FIG. 1.

To effect a normal or complete flush in either embodiment shown in FIGS. 1 and 2, the operator need only to push down on main flush handle 36 which through main flush lever 42, pivots main valve 14 sufficiently such that main valve 14 fully opens by becoming entirely buoyant and permitting water held in tank 10 to completely empty through valve seat 16 and pipe 17 into bowl 21.

It is noted by the Inventor that by careful manipulation of the main flush handle 36, such as to barely lift main valve 14, the function of the invention is also effected. However, tests by the Inventor have shown that without a fixed limit to stop the upward pivoting of main valve 14, it becomes very difficult to assure that, firstly, a sufficient amount of water is passed through pipe 17 to effect the mini-flush and, secondly, that the pivoting main valve 14 will return to valve seat 16. Thus, the need for the invention is shown in order to consistently effect a desired mini-flush of sufficient flow of water while not having a full flush.

It is of course realized that the person operating the mini-flush handle may hold it for a time sufficient to drain all the water out of tank 10 and thus a full and complete flush is effected, although, it will not be done as rapidly as the normal full flush since the rate of flow of water leaving tank 10 has been affected by limiting the rise of main valve 14. Accordingly, to operate the invention, the operator must mentally determine the length of time he wishes to pull on ring 30 or operate the mini-flush handle 38 or, if the operator desires, he may operate the mini-flush system until his visual observation indicates the purposes of the mini-flush have been accomplished.

Figure 3:
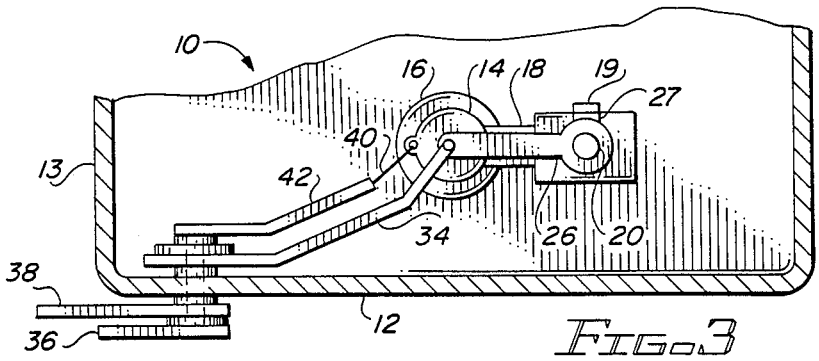
FIG. 3 is a top view of the alternate embodiment of the subject invention.

Referring now to FIG. 3, a top view of the two flush handle assemblies of the embodiment shown in FIG. 2 is detailed. More particularly, main flush handle 36 is attached to a center rod, shown dotted, which passes through front wall 12 of tank 10 to engage the second of the levers, mainly main flush lever 42. The mini-flush handle 38, being on the inside, is attached to a hollow tube surrounding the center rod attached to main flush handle 36, the hollow tube in turn attached to mini-flush lever 34. Thus, either one of the handles may be separately operated. Mechanisms of the type operating around a single axis or pivot point are common in the art and need not be further described.

Also seen in FIG. 3 is the top view of the mechanism which permits the lifting of the main valve 14. Proceeding from right to left, the fixture 18 which permits the pivoting of main valve 14 is shown with its set screw 19 by which attachment to overflow pipe 20 is made. Similarly, set screw 27 through which arm 26 is firmly attached to overflow pipe 20 is also shown. Proximate the end of arm 26 distal to overflow pipe 22 is opening 31 through which the cord 28 (not shown) connecting main valve 14 and lever arm 34 passes. To the left of overflow pipe 20 is shown main valve 14, valve seat 16 and the primary or original cord 40 attaching the main flush lever arm 42 to main valve 14.

Figure 4:
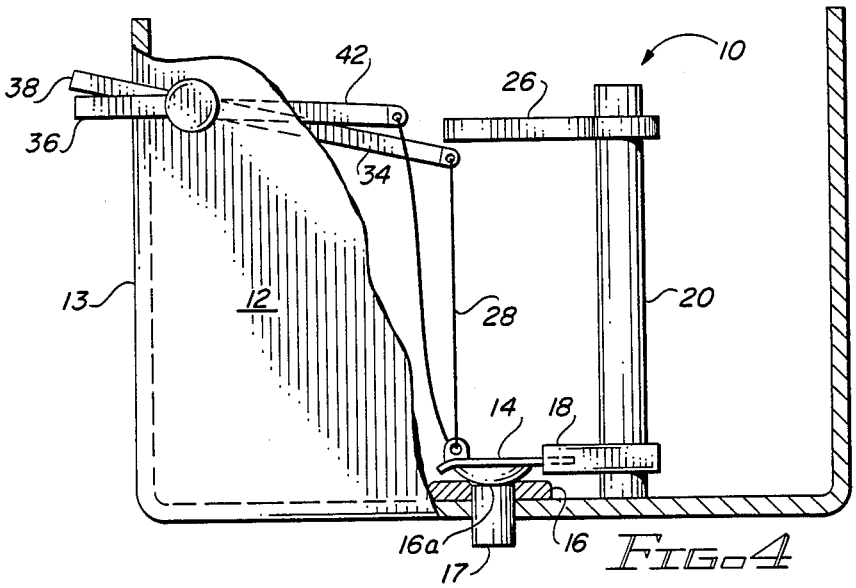
FIG. 4 is a front view of another alternate embodiment of the subject invention.

Referring now to FIG. 4, another alternate embodiment of the embodiment shown in FIG. 2 is detailed. In FIG. 4, the invention does not utilize the stop shown in FIG. 2 but merely limits the upward movement of lever arm 34 by positioning arm 26 to a location above lever arm 34. Cord 28 still attaches main valve 14 to lever arm 34. In this embodiment, pressing down on mini-flush handle 38 causes lever arm 34 to rise until it strikes the outstanding portion of arm 26, whereupon lever arm 34 stops. Thus, limiting the travel of lever arm 34 also limits the distance at which main valve 14 is permitted to rise above valve seat 16, limiting the opening of the main valve, and again the partial or mini-flush is effected.

Figure 5:
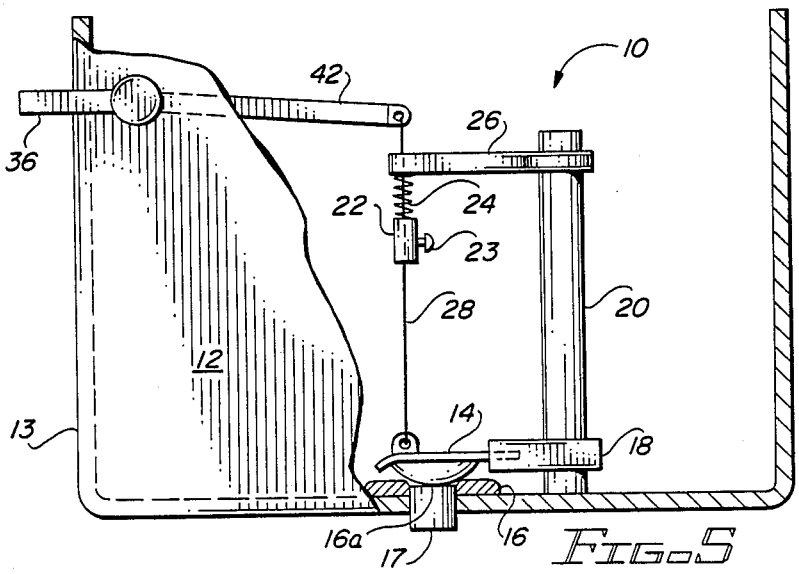
FIG. 5 is a front view of a third alternate embodiment of the subject invention.

FIG. 5 is still another embodiment of the subject invention wherein the partial or mini-flush is effected through the main flush mechanism. In FIG. 5, utilizing the main flush handle 36 and its associated lever arm 42, main valve 14 is tied to the end of lever arm 42 by cord 28. Stop 22 is located upon cord 28 with cord 28 still passing through the hole or opening in arm 26. However, in FIG. 5, compression spring 24 is attached to the bottom of arm 26 so that its coils are concentrically located around the hole in arm 26. Stop 22 is correctly positionally located upon cord 28 and secured there by screwing in butterfly set screw 23 to compress the cord in the longitudinal hole running through stop 22.

The embodiment shown in FIG. 5 works thusly. Main flush handle 36 is depressed raising lever arm 42 and accordingly, raising and thus opening main valve 14 through connecting cord 28. When main valve 14 has been raised a small predetermined distance above valve seat 16 by cord 28 traveling its predetermined lengthwise distance, stop 22 engages the lower edge of spring 24. At this point, the operator depressing main flush handle 36 will feel the effects of spring 24 and he may then stop exerting continued force on handle 36 and hold it there momentarily to permit the partial flush to take effect. If, however, the operator wishes for a full flush, he need only apply additional downward pressure to handle 36, forcing stop 22 to compress spring 24 and thus raise pivoting main valve 14 an additional distance upward until it becomes buoyant and main valve 14 opens fully. The continued upward distance that main valve 14 need rise may be made, by careful adjustment, sufficiently small such that the buoyant effect of main valve 14 will overcome the downward urging forces upon minimal compression of the spring and thus carry valve 14 upward to float at its most upwardly raised position to allow water unimpeded by valve 14 to enter into pipe 17 and into the toilet bowl.

Accordingly, by the embodiment shown in FIG. 5, the operator only needs to depress flush handle 36 until he feels resistance to continued downward movement of the handle. He has, at that time, raised main valve 14 sufficient to commence the mini-flush. The mini-flush can then be terminated by the operator by releasing his hold on handle 36, allowing lever 42 to drop and allowing main valve 14 to return to its position on valve seat 16 and stopping water flow.

Figure 6:
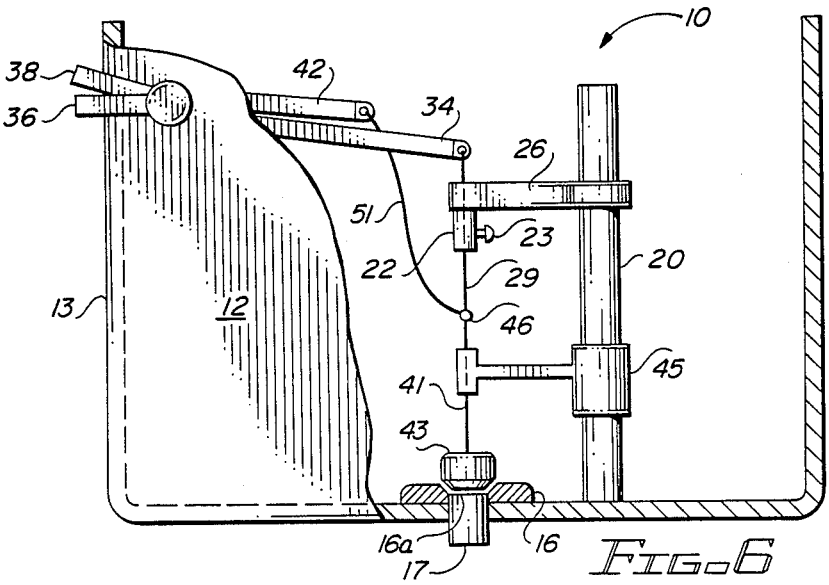
FIG. 6 is a front view of the first alternate embodiment of the invention utilizing an older style toilet main valve.

Referring lastly to FIG. 6, the invention is shown in place wherein the main valve 14 which had previously operated by pivoting from fixture 18, is replaced by the older style main valve 43, which rises and falls vertically over valve seat 16, the horizontal movement of main valve 43 limited by a connecting rod stem 41 passing through a centrally located hole in a sleeve of added fixture 45. Valve rod stem 41, which usually is an elongated metal rod, is firmly attached at one end to main valve 43 and is terminated at its other end by eyelet 46. In the usual single flush toilet, the normal main flush lever arm, such as 42 shown in FIG. 4, attaches by means of cord 51. The inventive elements are added as they were in the other Figures, comprising arm 26 attached to overflow pipe 20, arm 26 having a centrally located hole running therethrough to receive and pass cord 29. Cord 29, like its counterpart in FIGS. 1 and 2, attached to eyelet 46 at one end and to mini-flush lever 34 at the other end. Again, stop 22 is situated at a selected point along cord 29 and held there by means of butterfly set screw 23.

The embodiment shown in FIG. 6 operates similarly as described for the embodiments shown in FIGS. 2 through 4, the upward travel of main valve 43 controlled by the positional setting of stop 22 on cord 29. In the embodiment shown in FIG. 6, main valve 43 is not seated to valve seat 16, and some distance separates stop 22 from extension 24, however, the Figure was drawn this way in order to make more clear the different elements of the invention. Of course the same caveats apply to the embodiment shownn in FIG. 6 as were present in the other embodiments, i.e., if stop 22 is set too low on cord 29, operating the mini-flush handle will result in main valve 43 being pulled up too far above valve seat 16 so that there is insufficient suction to pull main valve 43 down upon valve seat 16 and therefore the effect of the mini-flush has been lost and the result will be a full flush.

In reviewing FIGS. 1–6, it is apparent that the means to lift or pivot main valve 14 off valve seat 16 and thus open main valve 14 comprises in the various embodiments cord 28 in FIGS. 1, 2, 4 and 5, and cord 29 in FIG. 6 together with ring 30 shown in FIG. 1 and lever 34 and associated handle 38 shown in FIGS. 2–4, and 6. Further, it is also apparent that the means to limit the opening of main valve 14 is accomplished by limiting the distance main valve 14 is lifted off valve seat 16 and includes stop 22 attached to cord 28 (and cord 29) working co-jointly with arm 26 (FIGS. 1, 2, 5, and 6), as well as arm 26 acting as a stop to lever 34 in FIG. 4.

In addition, it has been found useful for the embodiments of the invention which utilize the cord, string, or chain 28 (FIGS. 1, 2, 4) or 29 (FIG. 6) to attach that cord to the existing original cord, string or chain 40 (FIGS. 1, 2, 3, 4) or 51 (FIG. 6) at a point some what above the main valve (but not so far as to interfere with the invention) rather than to the main valve itself. This helps to keep the two cords from tangling.

While a preferred embodiment of the device, together with alternate embodiments of the device, have been shown and described, it will be understood that there is no intent to limit the invention by its disclosure, but rather it is intended to cover all modifications and alternate constructions falling within the spirit and the scope of the invention as defined in the appended claims.

I claim:

1. An improved dual flush system providing a partial flush in addition to the usual complete flush for toilets of the type having an upper water holding tank and a lower waste receiving bowl, the water holding tank having a valve seat situated in the lower portion thereof connective to a water discharge port operably connecting to the bowl, a main valve operably situated on said valve seat adapted to be lifted off a sufficient distance to become buoyant and thereby become fully open and pass all water held in the tank into the water discharge port and into the bowl for the complete flush, an overflow pipe situated proximate the valve seat, and a main flush handle and lever pivotally attached to the tank and operably connected to the main valve, the improvement to effect a partial flush comprising:

means to open the main valve to permit water to flow into the discharge port and into the bowl; and means to limit the opening of the main valve to prevent the main valve from becoming buoyant and fully open, said means including (1) means to lift the main valve off the valve seat a predetermined distance including a cord having a length with first and second ends and capable of lengthwise travel, said cord first end attached to the main valve, the main valve lifted off the valve seat by lengthwise travel of said cord; and (2) means to limit the lengthwise travel of said cord to said predetermined distance including an arm operably attached to the overflow pipe, said arm having an opening therethrough receiving and passing said cord through said arm, and a stop positionally attached to said cord between said cord first end and said arm, said stop so positionally attached to said cord as to strike said arm after said predetermined lengthwise travel of said cord to terminate further lengthwise travel whereby the main valve is lifted off the valve seat said predetermined distance by said cord lengthwise travel in order that the main valve does not become buoyant and will return to the valve seat when the main valve is no longer being held up by said cord thereby only a partial flush of the bowl is effected and not a complete flush by retaining control over the opening of the main valve in order that the main valve may be closed prior to a complete flush.

2. The improved dual flush system for toilets as defined in claim 1 wherein said means to lift the main valve off the valve seat includes a ring attached to said cord second end whereby an operator may pull on said ring to impart lengthwise travel to said cord until stopped and thereby lift the main valve off the valve seat said predetermined distance and effect a partial flush as desired.

3. The improved dual flush system for toilets as defined in claim 1 wherein said means to lift the main valve off the valve seat includes a partial flush handle and lever pivotally attached to the tank, said partial flush handle and lever also attached to said cord second end whereby an operator may operate said partial flush handle and lever to impart lengthwise travel to said cord until stopped and thereby lift the main valve off the valve seat said predetermined distance and effect a partial flush.

4. The improved dual flush system for toilets as defined in claim 1 further including a spring surrounding said cord positioned between said stop and said arm, said spring just engaged by both said stop and said arm when said cord has traveled said predetermined lengthwise distance, and further lengthwise travel of the cord may only be accomplished by compressing said string.

5. The improved dual flush system for toilets as defined in claim 4 wherein said cord second end is attached to the main flush handle and lever whereby an operator may effect a partial flush by operating said main flush handle to move the lever to impart lengthwise travel to said cord until the stop, spring, and arm are all engaged and the spring provides resistance to further movement of the partial flush handle, and if a complete flush is desired, the operator may further operate the main flush handle to compress the spring and lift the main valve off the valve seat until the main valve becomes buoyant and fully open.

6. An improved dual flush system providing a partial flush in addition to the usual complete flush for toilets of the type having an upper water holding tank and a lower waste receiving bowl, the water holding tank having a valve seat situated in the lower portion thereof connective to a water discharge port operably connecting to the bowl, a main valve operably situated on said valve seat adapted to be lifted off a sufficient distance to become buoyant and thereby become fully open and pass all water held in the tank into the water discharge port and into the bowl for the complete flush, an overflow pipe situated proximate the valve seat, and a main flush handle and lever pivotally attached to the tank and operably connected to the main valve, the improvement to effect a partial flush comprising:

means to open the main valve to permit water to flow into the discharge port and into the bowl; and means to limit the opening of the main valve to prevent the main valve from becoming buoyant and fully open, said means including (1) means to lift the main valve off the valve seat a predetermined distance including a cord having a length with first and second ends and capable of lengthwise travel, said cord first end attached to the main valve, and a partial flush handle and lever pivotally attached to the tank and attached to said cord second end, the main valve lifted off the valve seat by lengthwise travel of said cord; and (2) means to limit the lengthwise travel of said cord to said predetermined distance includes an arm operably attached to the overflow pipe, said arm so positioned to intersect the movement of said partial flush handle and lever, whereby after said partial flush handle and lever has imparted a predetermined lengthwise travel to said cord, said partial flush handle and lever strikes said arm and further movement is prevented whereby the partial flush is effected.

* * * * *